US008434751B2

(12) United States Patent
Sakata

(10) Patent No.: US 8,434,751 B2
(45) Date of Patent: May 7, 2013

(54) Z-FOLDER FOR SHEETS OF VARIOUS SIZES

(75) Inventor: Munetaka Sakata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 154 days.

(21) Appl. No.: 12/643,426

(22) Filed: Dec. 21, 2009

(65) Prior Publication Data

US 2010/0167891 A1 Jul. 1, 2010

(30) Foreign Application Priority Data

Dec. 26, 2008 (JP) ..... 2008-332941

(51) Int. Cl.
*B65H 37/06* (2006.01)

(52) U.S. Cl.
USPC ..... 270/45; 270/39.06; 493/419

(58) Field of Classification Search ..... 270/39.06, 270/39.07, 45, 58.07; 493/419, 420, 421
See application file for complete search history.

(56) References Cited

U.S. PATENT DOCUMENTS

| | | | | |
|---|---|---|---|---|
| 5,364,332 | A * | 11/1994 | Gray, Jr. | 493/23 |
| 6,719,283 | B2 * | 4/2004 | Tsuchiya et al. | 270/58.07 |
| 7,125,374 | B2 * | 10/2006 | Abramson et al. | 493/420 |
| 2003/0062666 | A1 * | 4/2003 | Hosoya et al. | 270/58.07 |
| 2009/0227436 | A1 * | 9/2009 | Takahashi | 493/420 |

FOREIGN PATENT DOCUMENTS

| | | | |
|---|---|---|---|
| JP | 2003-160274 | A | 6/2003 |
| JP | 2003160274 | A * | 6/2003 |
| JP | 2008-169029 | A | 7/2008 |
| JP | 2008-184320 | A | 8/2008 |

* cited by examiner

*Primary Examiner* — Patrick Mackey
(74) *Attorney, Agent, or Firm* — Canon U.S.A., Inc. IP Division

(57) ABSTRACT

An apparatus compares, when executing a job using sheets of a first size and sheets of a second size having a greater width in a sheet conveyance direction than the first size, the width in the conveyance direction of the sheets of the first size with the folding width of the sheets of the second size. The apparatus controls execution of a job based on a comparison result between the width in the conveyance direction of the sheets of the first size and the folding width of the sheets of the second size.

10 Claims, 18 Drawing Sheets

Z = X

Z < X

Z-FOLDER FOR SHEETS OF VARIOUS SIZES

BACKGROUND OF THE INVENTION

1. Field of the Invention

The present invention relates to a sheet processing apparatus and a sheet processing method.

2. Description of the Related Art

Conventionally, a sheet processing apparatus connected to an image forming apparatus has the function of folding sheets output from the image forming apparatus in a Z shape as one of their functions. Further, the image forming apparatus has the function of reading a document bundle including mixed documents of different sizes by a scanner and outputting sheets on which the read documents have been copied, mixing sheets in different sizes.

By employing these functions, when mixed documents of different sizes in the same grouping, e.g., documents mixing the A3 size (420 mm by 297 mm) and the A4 size (297 mm by 210 mm), both of which belong to the same grouping, are printed, sheets of the A3 size can be Z-folded into sheets of the A4 size.

As an example of a technique for producing a sheet bundle using a folding function when sheets of different sheet sizes are mixed, a reference sheet is determined to be a standard of length and sheets longer than the reference sheet are subjected to Z-folding or double-folding to conform to a reference sheet length (see Japanese Patent Application Laid-Open No. 2003-160274).

In the above-mentioned conventional technique, however, the sheets are folded to have a reference sheet length. Therefore, the sheets having folding widths other than the reference sheet length cannot be included in the sheet bundle.

SUMMARY OF THE INVENTION

According to an embodiment of the present invention, an apparatus includes an execution unit configured to execute a job using sheets of a first size and sheets of a second size having a greater width in a conveyance direction than the first size, a setting unit configured to set a folding width in the conveyance direction of the sheets of the second size used in the job, a folding unit configured to fold the sheets of the second size according to the set folding width, a comparison unit configured to compare the width in the conveyance direction of the first size with the set folding width, and a control unit configured to control execution of the job based on a comparison result by the comparison unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
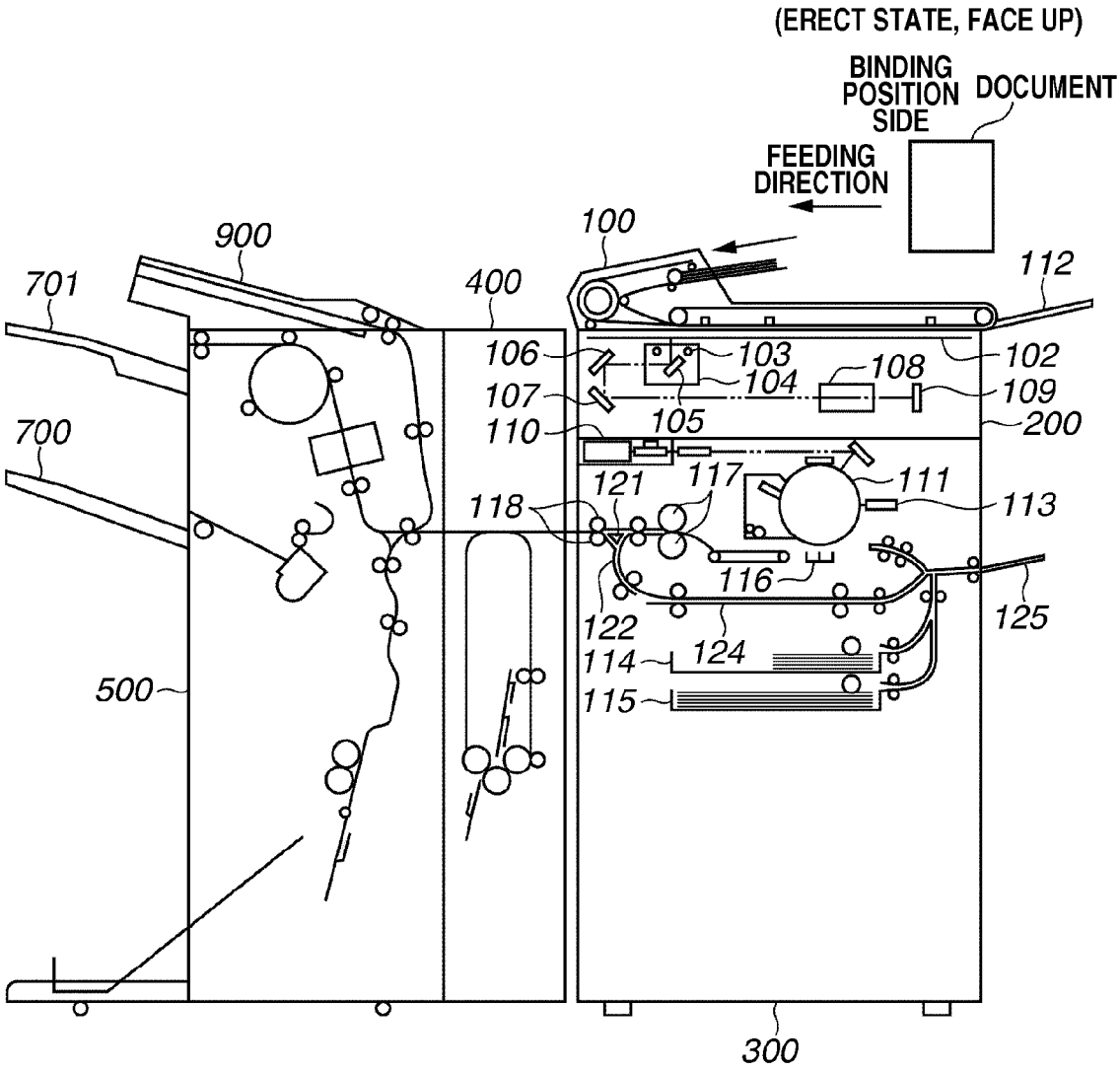
FIG. 1 is a cross-sectional view illustrating the configuration of an image forming apparatus according to the present exemplary embodiment.

FIG. 1 is a cross-sectional view illustrating the configuration of an image forming apparatus according to a first exemplary embodiment. The schematic configuration of the whole image forming apparatus will be described below with reference to FIG. 1. Although in the present exemplary embodiment, a folding device 400 and a finisher device 500 are connectable as options to the image forming apparatus, the image forming apparatus may be a multi-function image forming apparatus including a printer unit and a scanner unit. More specifically, the present invention is applicable to the multi-function image forming apparatus if the folding device 400 and the finisher device 500 are selectively connectable thereto. The present invention is also applicable to a configuration in which the folding device 400 is provided separately from the finisher device 500 or the finisher device 500 contains the built-in folding device 400.

The image forming apparatus according to the present exemplary embodiment can execute a job mixing sheets of different sizes. More specifically, the image forming apparatus to which the present invention is applied has the function of outputting such a job in which the size of a sheet first selected is A4 and the size of a sheet next output is A3.

Furthermore, the image forming apparatus according to the present exemplary embodiment can execute a copy job of reading a document and outputting an image and a print job of outputting printing information received from an information processing apparatus.

In FIG. 1, an image forming apparatus 1 includes a document feeder 100, an image reader 200, a printer 300, a folding device 400, and a finisher device 500. The document feeder 100 conveys set documents one at a time in order from the first page, rightward from the left over a platen glass 102 via a curved path, and then discharges the documents to a discharge tray 112. At this time, a scanner unit 104 is held at a predetermined position. The documents pass over the scanner unit 104 rightward from the left so that the documents are read.

Operation modes of the document feeder 100 include a mixed document mode for feeding documents including mixed documents of a large size and a small size in the same series in addition to a normal mode.

In the mixed document mode, documents P1 to P11 of sizes A4, A4, A4, A3, A4, A4, A3, A3, A4, A3, and A3, for example, can be fed. Although the lengths in a conveyance direction of the documents of the A4 size and the documents of the A3 size differ, the widths thereof in a main scanning direction in which an image is formed are the same. While the A4 size is the small size, the A3 size is the large size. Such a relationship between the sheet sizes is similar to that in B series. A similar relationship also holds between the Lettre size and the Legal size.

In the present exemplary embodiment, Z-folding can be similarly performed for the Lettre size and the Legal size, for example. The Legal size is 8.5 inches by 14 inches (215.9 mm by 355.6 mm), and the Lettre size is 8.5 inches by 11 inches (215.9 mm by 279.4 mm). Therefore, the Lettre size is the small size, and the Legal size is the large size.

The printer 300 can thus perform a printing job which has print of a plurality of sheets that differ in sheet size in at least one of a sheet conveyance direction (first direction) and a direction perpendicular to the conveyance direction (second direction). Examples of a job belonging to this type (a job using mixed sheets of different sizes) for printing on a plurality of sheets includes sheets of the A4 size and the A3 size, or sheets of the Lettre size and the Legal size.

After the printer 300 has completed the printing of mixed sheets of different sizes, the sheets are supplied to the finisher device 500 via the folding device 400. The folding device 400 subjects the sheets of the large size to folding processing such as Z-folding based on a user's instruction from an operation unit 108 (see FIG. 2). The sheets of the small size can be supplied directly to the finisher device 500 via the folding device 400 without being Z-folded.

The finisher device 500 binds the sheets of the large size that have been Z-folded in the folding device 400 and the sheets of the small size that are supplied via the folding device 400 without being Z-folded together according to the user's instruction from the operation unit 108. As a result, the sheets of the large size that have been Z-folded and the sheets of the small size that have not been Z-folded are bound together. This system (including the printer 300, the folding device 400, and the finisher device 500) is configured to carry out the printing according to processing conditions set in the operation unit 108 by a user to perform the job using mixed sheets of different sizes.

When the document passes through the scanning section in a reading process, the document is irradiated with light from a lamp 103 in the scanner unit 104. Light reflected from the document is guided into an image sensor 109 via mirrors 105, 106, and 107 and a lens 108. The document may also be read by moving the scanner unit 104 rightward from the left. In such a case, the document is stopped after being conveyed onto the platen glass 102 by the document feeder 100

An image of the document read by the image sensor 109 is processed, and is fed to an exposure control unit 110. The exposure control unit 110 outputs a laser beam corresponding to an image signal. A photosensitive drum 111 is irradiated with the laser beam, so that an electrostatic latent image is formed on the photosensitive drum 111. A developing unit 113 develops the electrostatic latent image on the photosensitive drum 111. A transfer unit 116 transfers a developer onto the photosensitive drum 111 on sheets fed from any one of cassettes 114 and 115, a manual feed unit 125, and a two-sided conveyance path 124.

The user can set the type of the sheets fed from the manual feed unit 125 or the cassette 114 or 115, e.g., thick paper sheets and overhead projector (OHP) sheets, from the operation unit 801. Optimum conveyance conditions and image formation conditions are selected depending on the type of the sheets. The operation unit 801 is provided with a folding position setting unit which sets a position for folding the sheets by the folding device 400, as described below.

A fixing unit 117 fixes the transferred developer on the sheet. The sheet, which has passed through the fixing unit 117, is guided into a path 122 once by a flapper 121, switched back after its rear end has passed through the flapper 121, and is guided into a discharge roller 118 by the flapper 121.

The discharge roller 118 thus discharges the sheet from the printer 300 with its surface facedown, on which the developer has been transferred.

The sheet that has been discharged by the discharge roller 118 is fed into the folding device 400. The folding device 400 (folding unit) folds the sheet according to a folding width X and a folding width Y that are set by the folding position setting unit. Folding processing is performed on the sheet having a width greater than the folding width X, while it is not performed on the sheet having a width smaller than the folding width X. The sheet for which folding processing has not been designated is fed as it is into the finisher device 500.

The finisher device 500 performs processing such as bookbinding processing, binding processing, and punching processing. An inserter 900 is provided on the finisher device 500, and feeds a front cover, an interleaf, and so on into the finisher device 500. A stack tray 700 and a sample tray 701 are further provided on the finisher device 500.

Figure 2:
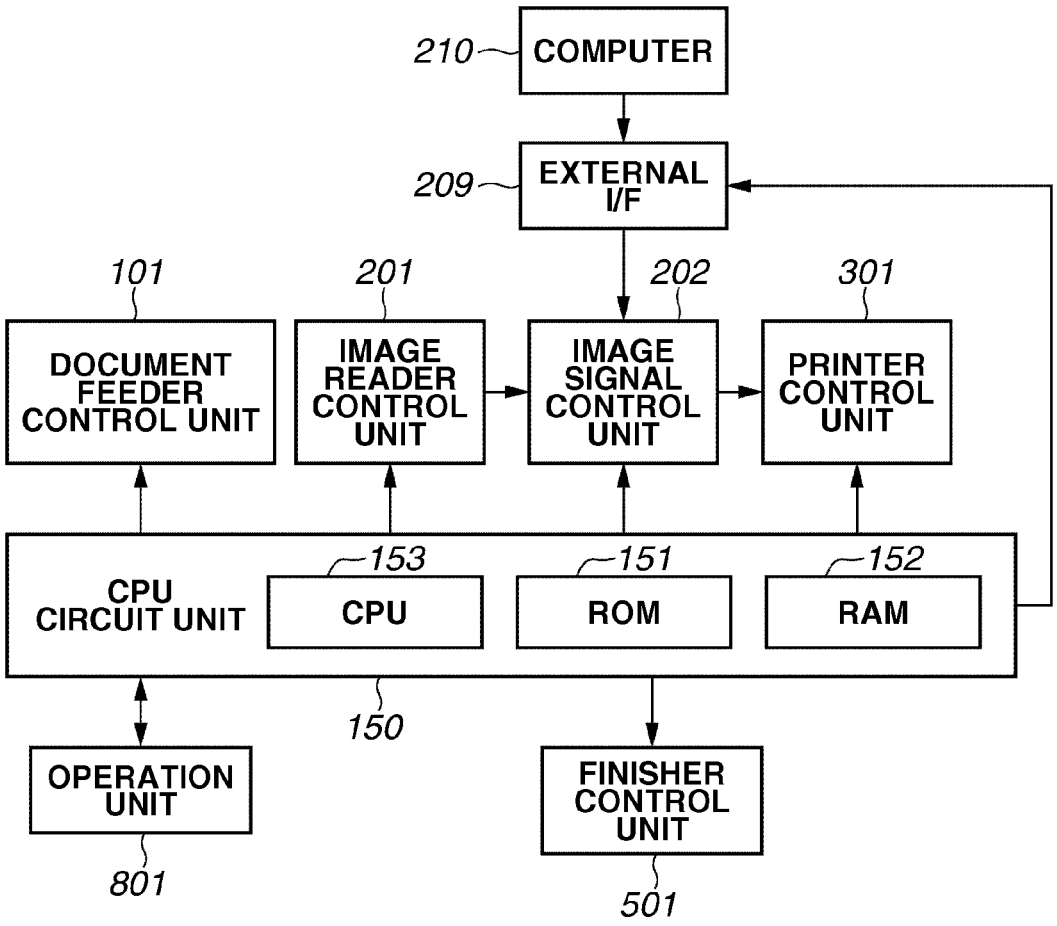
FIG. 2 is a block diagram illustrating the control configuration of the image forming apparatus illustrated in FIG. 1.

FIG. 2 is a block diagram illustrating the control configuration of the image forming apparatus 1 illustrated in FIG. 1. A control system of the image forming apparatus 1 will be described below with reference to FIG. 2.

In FIG. 2, a central processing unit (CPU) circuit unit 150 includes a CPU 153, and controls control units, described below, according to a program stored in a read-only memory (ROM) 151 and setting of the operation unit 801. The control units include a document feeder control unit 101, an image reader control unit 201, an image signal control unit 202, a printer control unit 301, a folding device control unit 401, a finisher control unit 501, and an external interface (I/F) 209.

The document feeder control unit 101, the image reader control unit 201, and the printer control unit 301 respectively control the document feeder 100, the image reader 200, and the printer 300 illustrated in FIG. 1. The folding device control unit 401 and the finisher control unit 501 respectively control the folding device 400 and the finisher device 500.

A random access memory (RAM) 152 is used as a region where control data is temporarily held and a work area for an operation involved in the control. The external I/F 209 is an interface receiving data from a computer 210, and rasterizes print data to an image and outputs the image to the image signal control unit 202. An image read by the image sensor 109 is output from the image reader control unit 201 to the image signal control unit 202, and an image output from the image signal control unit 202 to the printer control unit 301 is input to the exposure control unit 110 (see FIG. 1).

Figure 3:
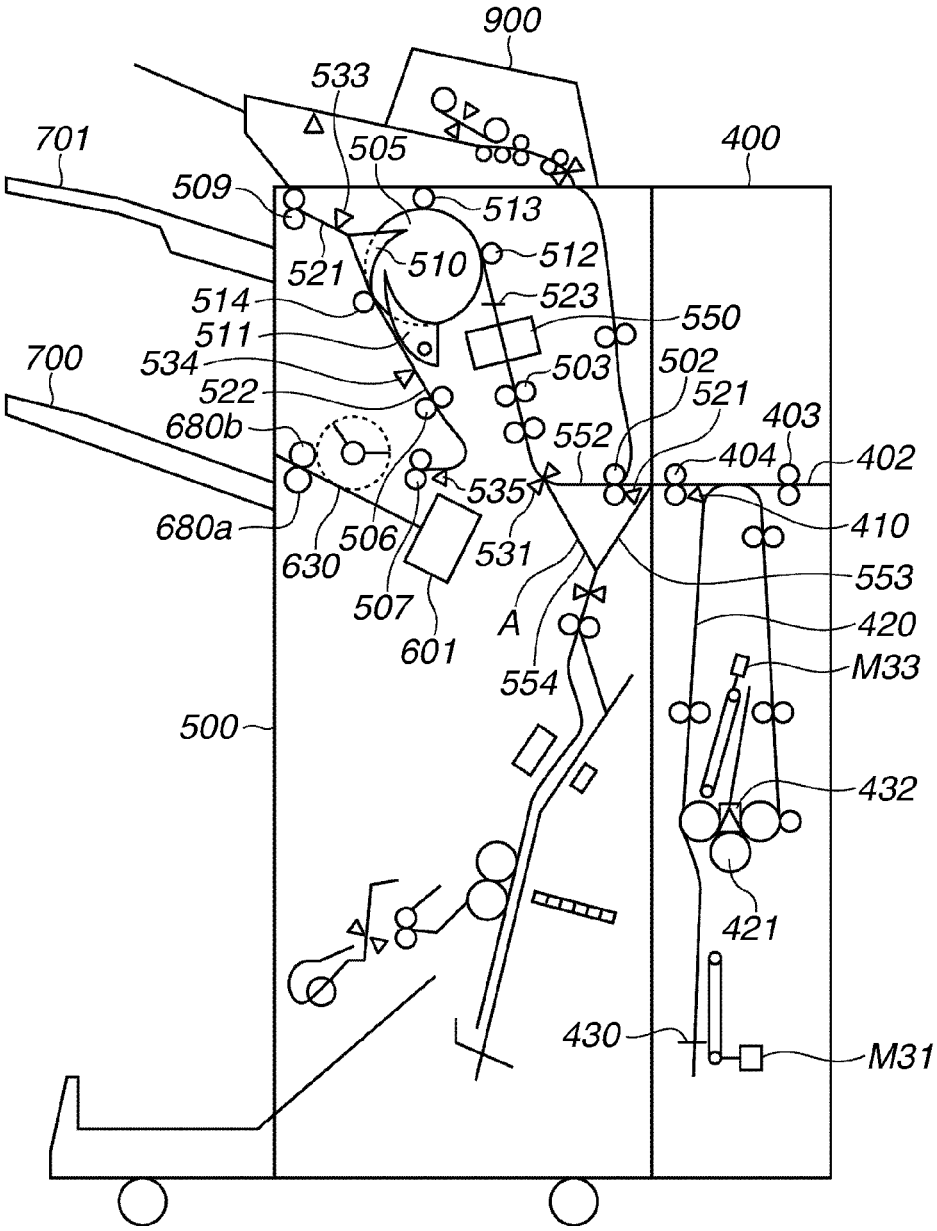
FIG. 3 is a cross-sectional view illustrating the configurations of a folding device and a finisher device illustrated in FIG. 1.

FIG. 3 is a cross-sectional view illustrating the configurations of the folding device 400 and the finisher device 500 illustrated in FIG. 1. The configuration of the folding device 400 serving as a sheet processing apparatus will be described below with reference to FIG. 3.

In FIG. 3, the folding device 400 has a folding conveyance horizontal path 402 for guiding sheets discharged from the printer 300 toward the finisher device 500.

Conveyance roller pairs 403 and 404 are provided on the folding conveyance horizontal path 402. A folding path selection flapper 410 is provided at an outlet (on the side of the finisher device 500) of the folding conveyance horizontal path 402. The folding path selection flapper 410 performs a switching operation to guide the sheet on the folding conveyance horizontal path 402 toward a folding path 420 or the finisher device 500. A first folding stopper drive motor M31 drives a first folding stopper 430, and a second folding stopper drive motor M33 drives a second folding stopper 432.

When folding processing is performed, the folding path selection flapper 410 is turned on, so that the sheet is guided into the folding path 420. The sheet guided into the folding path 420 is conveyed to a folding roller 421, and is folded in a Z shape. On the other hand, when folding processing is not performed, the folding path selection flapper 410 is turned off, so that the sheet is directly fed into the finisher device 500 from the printer 300 via the folding conveyance horizontal path 402.

The finisher device 500 accepts sheets discharged via the folding device 400 in order. Post-processing such as processing for aligning a plurality of sheets accepted and binding the sheets into one bundle, stapling processing for binding a rear end of a sheet bundle with a staple, and sorting processing is selectively performed depending on setting from the operation unit 801 illustrated in FIG. 2. The user displays a user interface, described below, on a display unit in the operation unit 801 to make various types of setting relating to folding processing.

The configuration of the finisher device 500 will be further described with reference to FIG. 3.

In FIG. 3, the finisher device 500 includes an inlet roller pair 502 for guiding sheets discharged from the printer 300 into its inside via the folding device 400.

A switching flapper 551 for guiding the sheet into the finisher path 552 or a first bookbinding path 553 is provided on the downstream side of the inlet roller pair 502.

The sheet that has been guided into the finisher path 552 is fed toward the buffer roller 505 via a conveyance roller pair 503. The conveyance roller pair 503 and the buffer roller 505 are rotatable in forward and reverse directions.

An inlet sensor 531 is provided between the inlet roller pair 502 and the conveyance roller pair 503. A second bookbinding path 554 is branched from the finisher path 552 (a branch point is referred to as a branch Y) in the vicinity of the upstream side in the sheet conveyance direction of the inlet sensor 531.

Furthermore, a punch unit 550 may be provided between the conveyance roller pair 503 and the buffer roller 505 to punch a hole in the vicinity of a rear end of the conveyed sheet.

The buffer roller 505 is a roller on and around which a predetermined number of sheets fed to its outer periphery via the conveyance roller pair 503 are loaded and wound. Each of press rollers 512, 513, and 514 winds the sheet around the outer periphery of the buffer roller 505 during the rotation.

A switching flapper 510 is arranged between the press rollers 513 and 514, and a switching flapper 511 is arranged on the downstream side of the press roller 514. The switching flapper 510 is a flapper for stripping from the buffer roller 505 the sheet wound around the buffer roller 505 and guiding the sheet to a nonsort path 521 or a sort path 522. The switching flapper 511 is a flapper for guiding the sheet wound around the buffer roller 505 into the sort path 522 or a buffer path 523.

The sheet guided into the nonsort path 521 is discharged to the sample tray 701 via the discharge roller pair 509. A nonsort sensor 533 for detecting a jam or the like is provided halfway on the nonsort path 521.

The sheet guided into the sort path 522 is loaded on an intermediate tray (hereinafter referred to as a processing tray) 630 via a conveyance roller pair 506 and a discharge roller pair 507. A sort path sensor 534 and a sheet discharge sensor 535 used for detecting a jam or the like are provided on a conveyance path of the sort path 522. A sheet bundle loaded on the processing tray 630 is discharged onto the stack tray 700 by discharge rollers 680*a* and 680*b* after being subjected to alignment processing and stapling processing.

The stack tray 700 can freely run in a vertical direction. A stapler 601 is used for stapling processing to bind the sheets loaded in a bundle shape on the processing tray 630.

Figure 4:
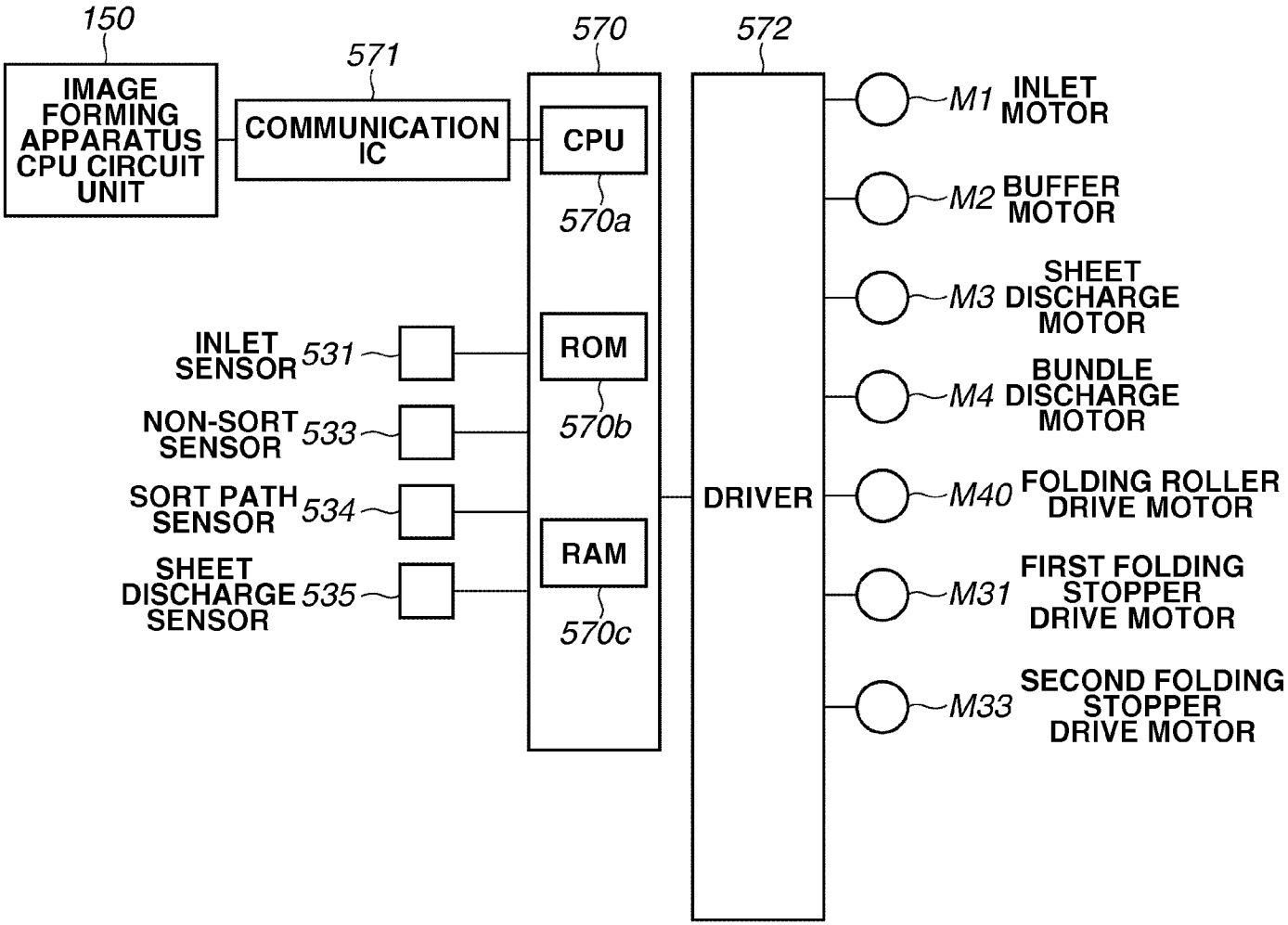
FIG. 4 is a block diagram illustrating the details of a finisher control unit illustrated in FIG. 2.
Figure 5A:
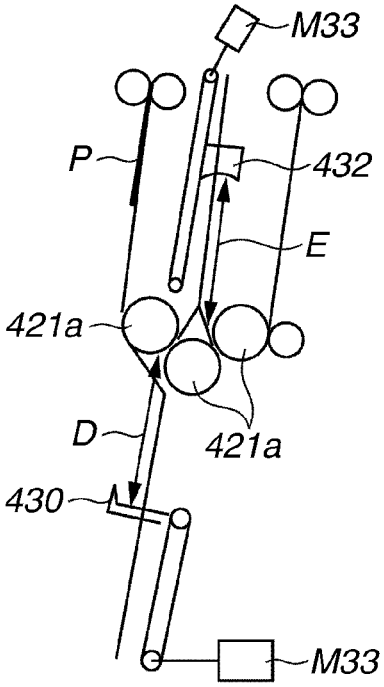
FIG. 5 is a cross-sectional view illustrating the details of a principal part of the folding device illustrated in FIG. 3.
Figure 5B:
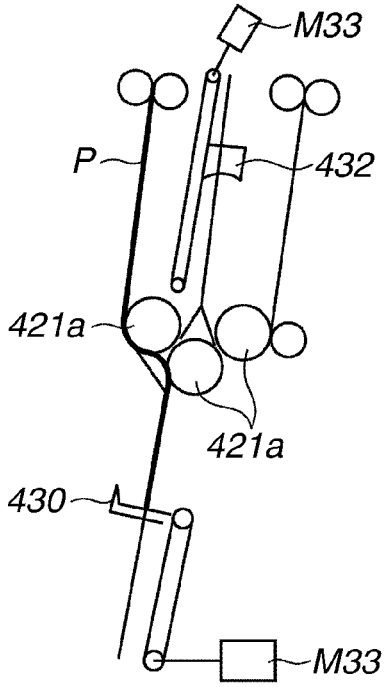
Figure 5C:
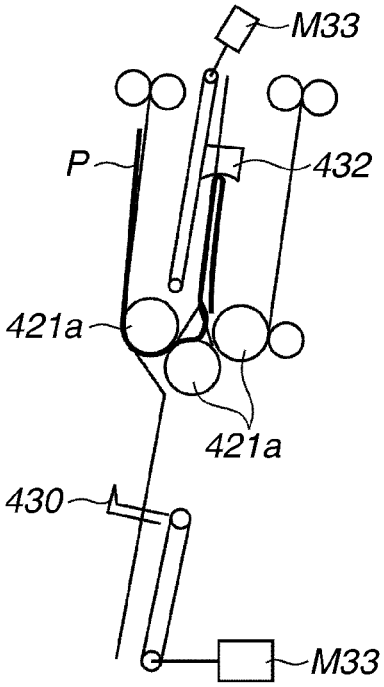
Figure 5D:
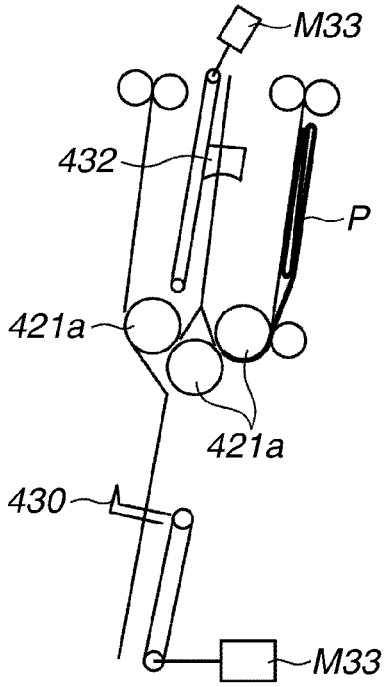

FIG. 4 is a block diagram illustrating the details of the finisher control unit 501 illustrated in FIG. 2. A control system of the finisher control unit 501 will be described below with reference to FIG. 4.

In FIG. 4, a CPU circuit unit 570 includes a CPU 570*a*, a ROM 570*b*, and a RAM 570*c*, and communicates with the CPU circuit unit 150 in the image forming apparatus 1 via a communication integrated circuit (IC) 571, to exchange data. The CPU 570*a* carries out control according to various programs stored in the ROM 570*b*. Data representing a folding width X and a folding width Y that are set by the user who operates the operation unit 801 functioning as the folding position setting unit are fed to the finisher control unit 501 via the communication IC 571. The set data representing the folding widths X and Y may also be previously set and stored in a non-volatile random access memory (NVRAM) or the like to be read out.

Various driver circuits 572 drive a motor, a solenoid, and a clutch upon receipt of a signal from the CPU circuit unit 570.

The inlet sensor 531, the nonsort sensor 533, the sort path sensor 534, and the sheet discharge sensor 535 are provided in each of the conveyance paths described in FIG. 3 to measure timings of detection of a jam and load operations.

An inlet motor M1 is a drive source of the inlet roller pair 502, the conveyance roller pair 503, and the conveyance roller pair 506. A buffer motor M2 is a drive source of the buffer roller 505. A sheet discharge motor M3 is a drive source of the conveyance roller pair 506, the discharge roller pair 507, and the discharge roller pair 509.

A bundle discharge motor M4 is a drive source of the discharge roller 680*a* and the discharge roller 680*b*. A first folding stopper drive motor M31 is a drive source of the first folding stopper 430. A second folding stopper drive motor M33 is a drive source of the second folding stopper 432. A folding roller drive motor M40 drives the folding roller 421.

The first folding stopper drive motor M31 and the second folding stopper drive motor M33 are composed of a stepping motor. The driver 572 controls an excitation pulse rate, to enable a stopper driven by each of the motors to be rotated at a constant speed and stopped at a predetermined position.

FIG. 5 is a cross-sectional view illustrating the details of a principal part of the folding device 400 illustrated in FIG. 3. The same components as those illustrated in FIG. 3 are assigned the same reference numerals. The detailed operation of Z-folding processing will be described below with reference to FIG. 5. In the present exemplary embodiment, a sheet P is folded in a Z shape in the following steps 1 to 3.

In step S1, the first folding stopper drive motor M31 is driven, to move the first folding stopper 430 to a position located a distance D apart from a nip of a first folding roller pair 421*a*, as illustrated in FIG. 5 (A). The position of the first folding stopper 430 is obtained by dividing a value obtained by subtracting a folding width X from the length in the conveyance direction of the folded sheet, by two.

In step 2, the sheet P that abuts on the first folding stopper 430 forms a loop in the vicinity of a nip of the first folding roller pair 421*a*, as illustrated in FIG. 5 (B), and the loop is folded by the first folding roller pair 421*a* and is conveyed.

In step 3, the second folding stopper drive motor M33 is then driven, to move the second folding stopper 432 to a position located a distance E (see FIG. 5 (A)) apart from a nip of a second folding roller pair 421*b*, as illustrated in FIG. 5 (C). The distance E from the position of the second folding stopper 432 is made equal to the distance D from the position of the first folding stopper 430. The sheet P that abuts on the second folding stopper 432 forms a loop in the vicinity of the second folding roller pair 421*b*, and the loop is folded by the second folding roller pair 421*b*, and is conveyed, as illustrated in FIG. 5 (*d*).

Figure 6:
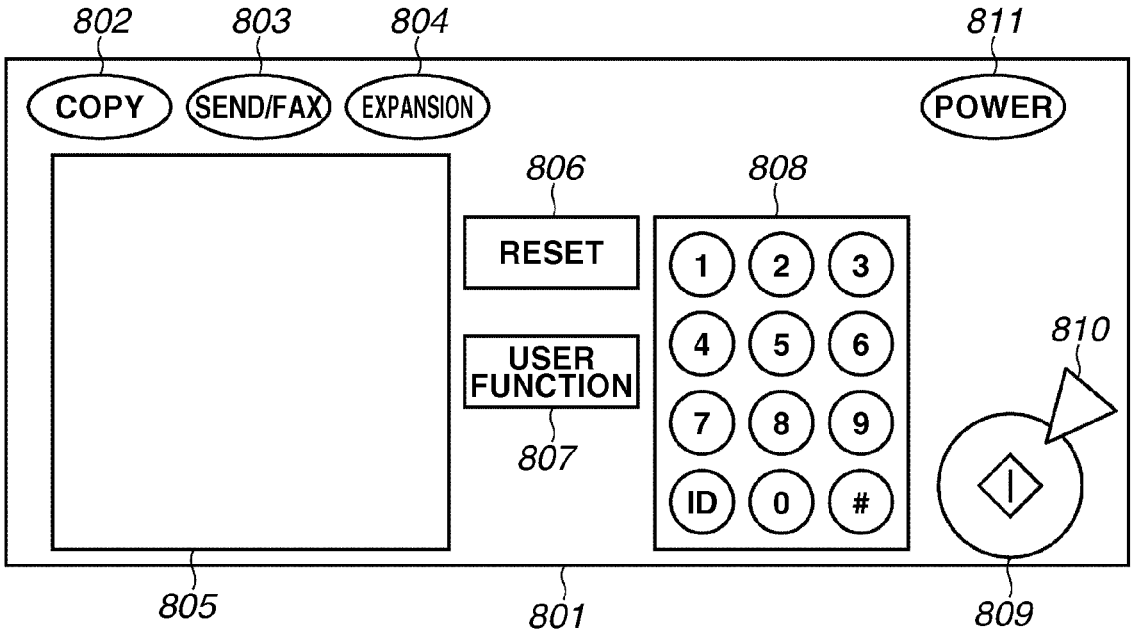
FIG. 6 is a plan view illustrating an example of an operation unit in the image forming apparatus illustrated in FIG. 2.

FIG. 6 is a plan view illustrating an example of the operation unit 801 in the image forming apparatus 1 illustrated in FIG. 2. The configuration of the operation unit 801 will be described below with reference to FIG. 6.

In the operation unit 801 illustrated in FIG. 6, a COPY function key 802, a SEND/FAX function key 803, and an EXPANSION function key 804 are provided above a liquid crystal panel 805 in the form of a touch panel. A RESET key 806, a USER FUNCTION key 807, a numeric keypad 808, a start key 809, and a stop key 810 are provided at the right of the liquid crystal panel 805.

The RESET key 806 is used in canceling contents input from the numeric keypad 808 and the liquid crystal panel 805 to return to an initial screen. The USER FUNCTION key 807 is used in calling various types of setting and an address book for each user stored in a nonvolatile memory, e.g., the NVRAM provided in the image forming apparatus 1.

The numeric keypad 808 is used in inputting a numerical value. The start key 809 is used in instructing the user to start copying or start scanning. The STOP key 801 is used in instructing the user to stop an operation.

In the image forming apparatus 1, the COPY function key 802 is pressed when a copy function is used. The SEND/FAX function key 803 is pressed when data representing a document such as a facsimile document is transmitted to another facsimile apparatus or a host computer. The EXPANSION function key 804 is assigned a function when it is desired to expand the function of the image forming apparatus 1.

A POWER key 811 is used when the user directly controls the power saving state of the image forming apparatus 1. When the user presses the POWER key 811 in the power saving state, the image forming apparatus 1 carries out power control to shift a power state to a standby (a power state where various jobs such as copying are immediately executable).

On the other hand, when the user presses the POWER key 811 in the standby state, the image forming apparatus 1 carries out power control to shift to the power saving state.

Figure 7:
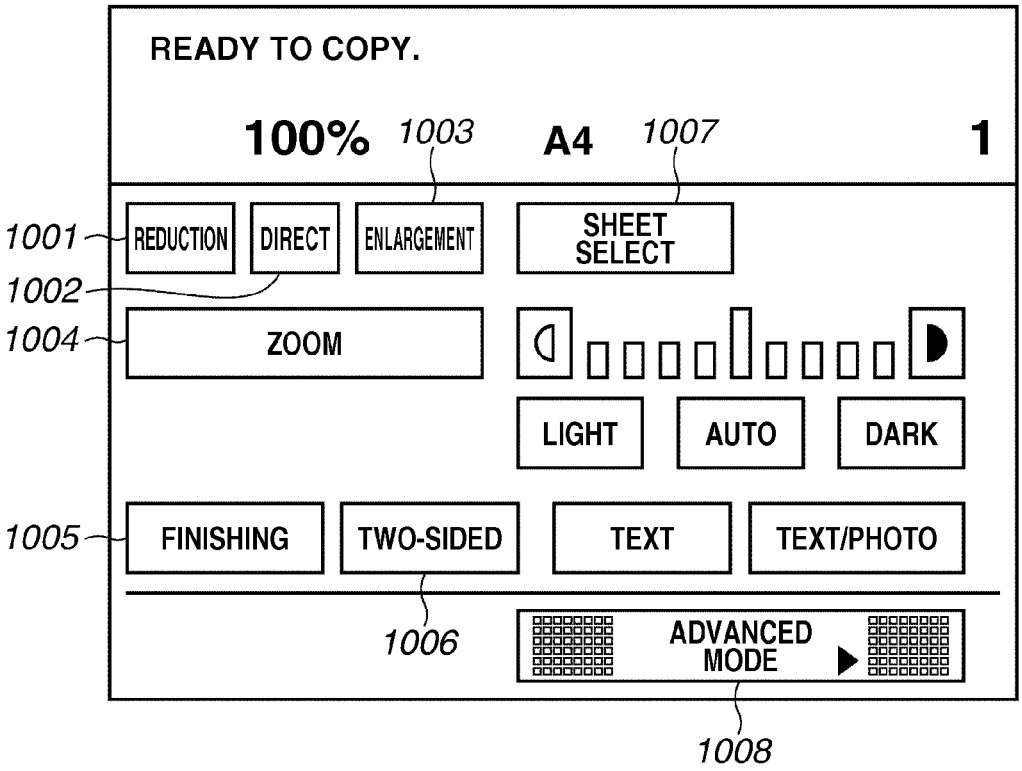
FIG. 7 illustrates an example of a copy function screen displayed on a liquid crystal panel illustrated in FIG. 6.

FIG. 7 illustrates an example of a copy function screen displayed on the liquid crystal panel 850 illustrated in FIG. 6. This screen is displayed on the liquid crystal panel 805 based on display control of the CPU 13 when the user presses the COPY function key 802. Currently, a copying operation mode setting screen is displayed on the liquid crystal panel 805. Keys 1001 to 1008 are displayed in the liquid crystal panel 805. The user presses the keys, to make mode setting for a main body of the image forming apparatus 1.

The TWO-SIDED printing setting key 1006 is used for setting two-sided printing. This key enables setting of a "one-sided/two-sided mode" for outputting two one-sided documents as one two-sided sheet, a "two-sided/two-sided mode" for outputting one two-sided document as one two-sided sheet, and a "two-sided/one-sided mode" for outputting one two-sided document as two one-sided sheets.

The SHEET SELECTION key 1007 is used for selecting sheets. The REDUCTION key 1001, the DIRECT key 1002, the ENLARGEMENT key 1003, and the ZOOM key 1004 are respectively used in setting copying magnifications in copying operations.

The ADVANCED MODE key 1008 is used insetting an image synthesizing function for performing synthesis of a read image and a form image, and for setting execution or release of an advanced function of a pamphlet mode for performing image forming processing in order suitable in producing a pamphlet.

Furthermore, the ADVANCED MODE key 1008 can also execute or release a reduction layout mode, an enlargement layout mode, and a mixed document mode so that documents of different sizes can be automatically fed and output as output sheets of different sizes.

A screen for setting each of the above-mentioned advanced function modes is displayed on the liquid crystal panel 805 by pressing the ADVANCED MODE key 1008. The user sets the advanced function mode on this screen.

The FINISHING key 1005 is used for setting finishing processing, and can set or release sorted sheet discharge processing, grouped sheet discharge processing, stapled sheet discharge processing, and Z-folding processing for folding half of the output sheet in a Z shape and discharging the folded output sheet.

Figure 8:
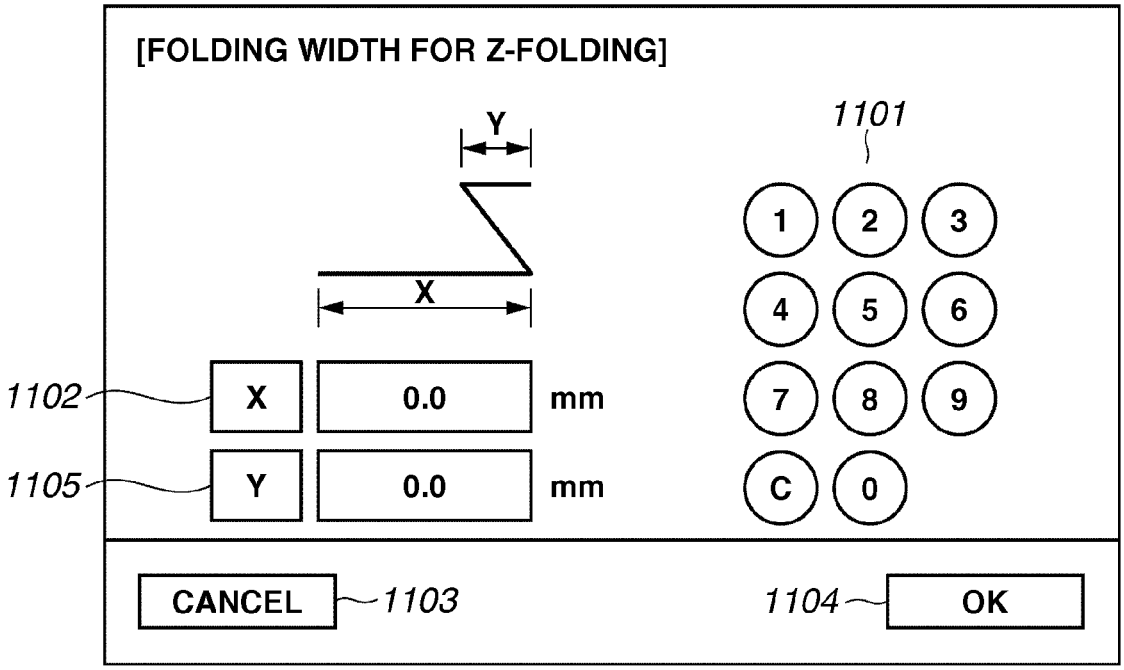
FIG. 8 illustrates an example of a folding width setting screen for Z-folding displayed on the liquid crystal panel illustrated in FIG. 6.

FIG. 8 illustrates an example of a folding width setting screen for Z-folding displayed on the liquid crystal panel 805 illustrated in FIG. 6. This screen is displayed by pressing the USER FUNCTION key 807 illustrated in FIG. 6, and pressing a folding width setting button for Z-folding (not illustrated), which is displayed after pressing a copy specification setting button (not illustrated).

On this screen, a folding width X can be set in the sheet conveyance direction for Z-folding. A numeric keypad 1101 is a numeric key for setting the folding width X. When the folding width X is set, a folding width X key 1102 is pressed, and the numeric keypad 1101 is then used to input the numerical value of the folding width X.

A CANCEL key 1103 is pressed when it is desired to discard the folding width X set on this screen. An OK key 1104 is pressed when it is desired to reflect the folding width X set on this screen in the image forming apparatus 1. The folding width X set in this setting is applied to all Z-folding processing performed in the image forming apparatus 1.

A folding width Y key 1105 for inputting the numerical value of a folding width Y using the numeric keypad 1101 may also be provided so that the folding width Y can be simultaneously set.

In this system, sheet folding processing (including Z-folding) is applied to each of following various jobs, as described below. Whether folding processing is applied to each of the jobs is determined on the basis of a user's instruction from the operation unit 801.

[1] A job not including sheets of a large size but including sheets of a small size as one set (one bundle) of sheets serving as a printing object, or a job not including sheets of a small size but including sheets of a large size as one set (one bundle) of sheets serving as a printing object. In other words, a job not using sheets of either one of a small size and a large size but using sheets of the other size, as one set (one bundle) of sheets serving as a printing object.

[2] A job using both sheets of a small size and sheets of a large size in printing of one set (one bundle) of sheets, i.e., a job including sheets of both a small size and a large size as one set (one bundle) of sheets serving as a printing object.

This system is configured that Z-folding is applied to the jobs of the above types, and processing in flowcharts as described below, is applied to the jobs.

Figure 9:
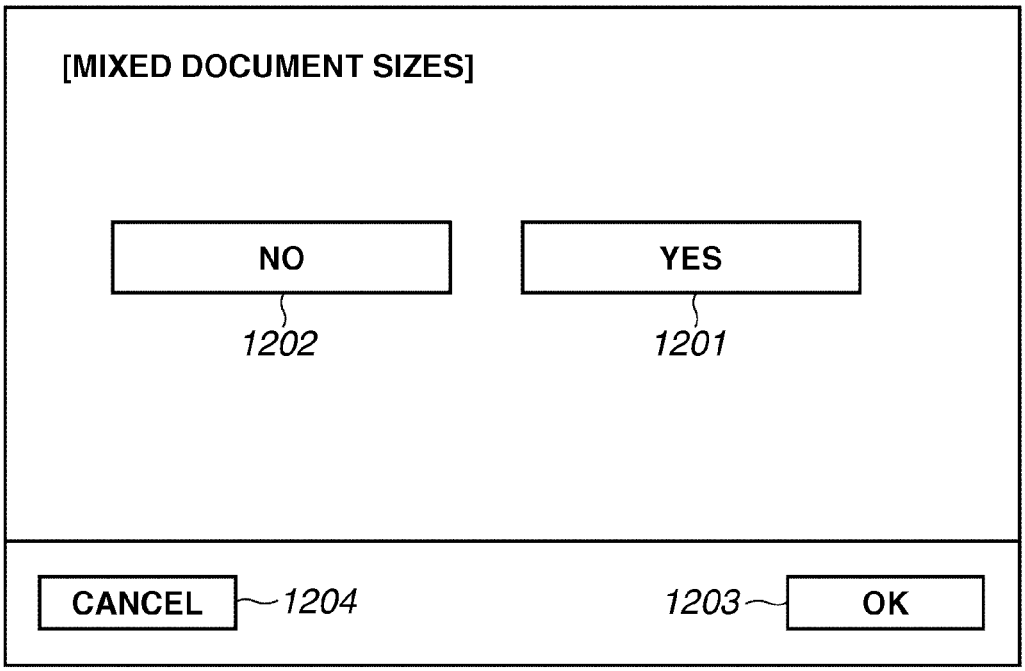
FIG. 9 illustrates an example of a mixed document size screen displayed on the liquid crystal panel illustrated in FIG. 6.

FIG. 9 illustrates an example of a mixed document size screen displayed on the liquid crystal panel 805 illustrated in FIG. 6. This screen is displayed when the ADVANCED MODE key 1008 illustrated in FIG. 7 is pressed and a mixed document size button (not illustrated) is pressed.

On this screen, it can be set whether a copying operation is performed in a mixed document size mode.

A YES key 1201 and a NO key 1202 are alternate keys. When it is desired to automatically feed and output documents of different sizes on output sheets of different sizes, the YES key 1201 is selected; otherwise, the NO key 1202 is selected.

A CANCEL key 1204 is pressed when it is desired to discard mixed document size setting made on this screen. An OK key 1203 is pressed when it is desired to make the mixed document size setting made on this screen effective.

Figure 10:
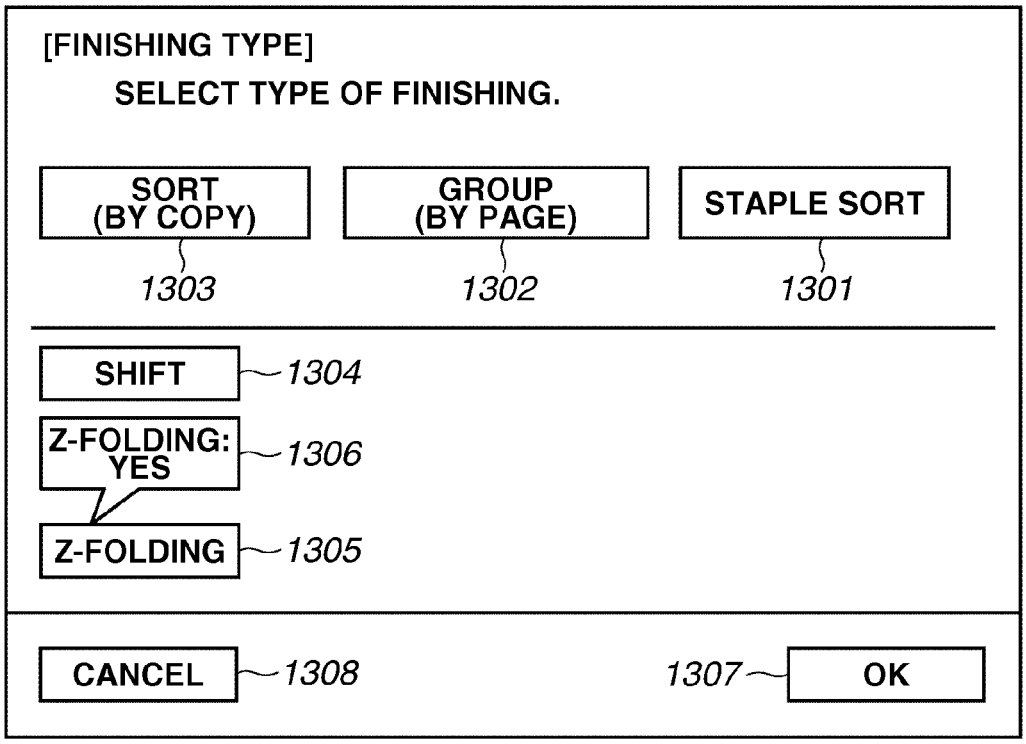
FIG. 10 illustrates an example of a finishing type selection screen displayed on the liquid crystal panel illustrated in FIG. 6.

FIG. 10 illustrates an example of a finishing type selection screen displayed on the liquid crystal panel 805 illustrated in FIG. 6. This screen is displayed when the FINISHING key 1005 illustrated in FIG. 7 is pressed.

On this screen, the type of finishing of a sheet bundle can be set. A SORT (BY COPY) key 1303, a GROUP (BY PAGE) key 1302, and a STAPLE SORT key 1301 are used to make a setting relating to alignment, and only one of the three keys is selectable.

The SORT (BY COPY) key 1303 is used when it is desired to align sheets and perform finishing for each copy. When ten copies of a 5-page document are printed, for example, the 5-page document is discharged as one copy. The GROUP (BY PAGE) key 1302 is used when it is desired to align sheets to perform finishing for each page. When ten copies of a 5-page document are printed, for example, sheets are sorted for each page and ten sheets are discharged as one copy.

The STAPLE SORT key 1301 is used when it is desired to staple sheets together to perform finishing. When ten copies of a 5-page document are printed, for example, five sheets are discharged being stapled together as one copy.

A SHIFT sort key 1304 has the function of shifting sheets back and forth and discharging the sheets in a bundle unit for each copy. A shift sorting function can be set in combination with the SORT (BY COPY) key 1303, the GROUP (BY PAGE) key 1302, and the STAPLE SORT key 1301.

A Z-FOLDING key 1305 is used for making setting as to whether Z-folding is performed. When Z-folding is set, Z-folding processing is performed for all pages according to the setting illustrated in FIG. 8. Setting as to whether or not Z-folding is set is made by pressing the Z-FOLDING key 1305. When Z-folding is set, a pop-up balloon 1306 for setting Z-folding is displayed to explicitly show that Z-folding is set. When Z-folding is not set, the display of the pop-up balloon 1306 for setting Z-folding is erased to explicitly show that Z-folding is not set. An OK key 1307 is pressed when it is desired to make the setting effective. A CANCEL key 1308 is pressed when it is desired to discard the setting.

Figure 11:
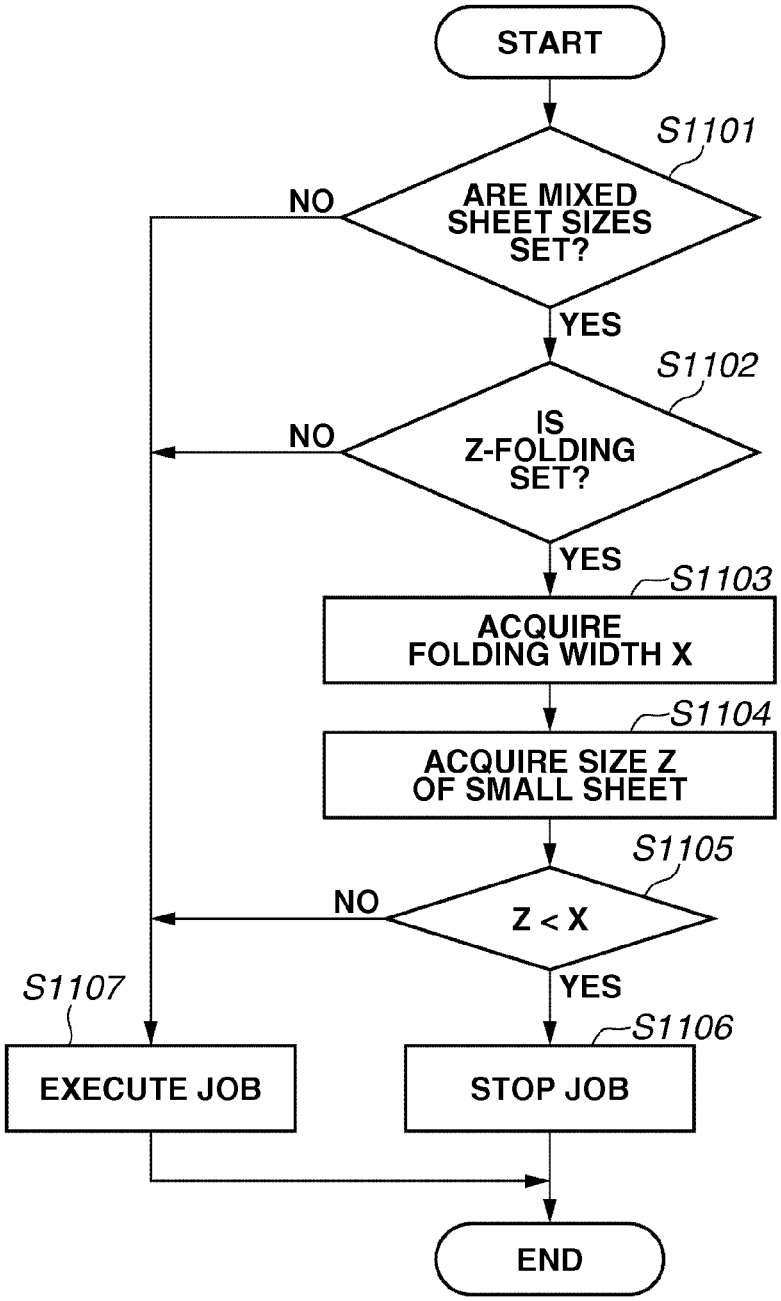
FIG. 11 is a flowchart illustrating an example of a sheet processing procedure in the image forming apparatus according to the present exemplary embodiment.

FIG. 11 is a flowchart illustrating an example of a sheet processing procedure in the image forming apparatus 1 according to the present exemplary embodiment. This example describes job processing in making a folding mode setting.

The CPU 153 illustrated in FIG. 2 loads a control program stored in the ROM 151 into the RAM 152 and executes the control program, to realize each of steps S1101 to S1107.

When the operation unit 801 accepts pressing of the start key 809 from the user while a document to be printed is placed on the document feeder 100, present processing is started.

In step S1101, the CPU 153 in the image forming apparatus 1 first determines whether mixed document (i.e., sheet) sizes (FIG. 9) are set. If the CPU 153 determines that the mixed document sizes are not set (NO in step S1101), then in step S1107, the CPU 153 executes a job, considering that the job is not a mixed document size job.

On the other hand, when the CPU 153 determines that the mixed document sizes are set (YES in step S1101), the processing proceeds to step S1102.

In step S1102, the CPU 153 in the image forming apparatus 1 determines whether Z-folding (FIG. 10) is set. If the CPU 153 determines that Z-folding is not set (NO in step S1102), then in step S1107, the CPU 153 executes a job, considering that the job is a mixed document size job in which Z-folding is not performed.

On the other hand, if the CPU 153 determines that Z-folding is set (YES in step S1102), the processing proceeds to S1103.

In step S1103, the CPU 153 in the image forming apparatus 1 acquires a folding width X set by the user using the operation unit 801 illustrated in FIG. 8. In step S1104 (i.e., acquire size Z of small sheet), the CPU 153 in the image forming apparatus 1 then determines cassettes containing print sheets for all documents read from the document feeder 100, and acquires the width in the conveyance direction of sheets of a small size as a sheet size Z (in the case of the A4 size, Z=210 mm).

In step S1105, the CPU 153 in the image forming apparatus 1 then compares the folding width X with the sheet size Z. As a result of comparing the width Z in the conveyance direction of the selected sheets of the small size with the folding width X, if the CPU 153 determines that Z<X (YES in step S1105), the processing proceeds to step S1106. In step S1106, the CPU 153 stops the job.

On the other hand, as a result of comparing the width Z in the conveyance direction of the selected sheets of the small size with the folding width X, if the CPU 153 determines that Z=X and Z>X (NO in step S1105), then in step S1107, the CPU 153 executes the job.

Figure 12A:
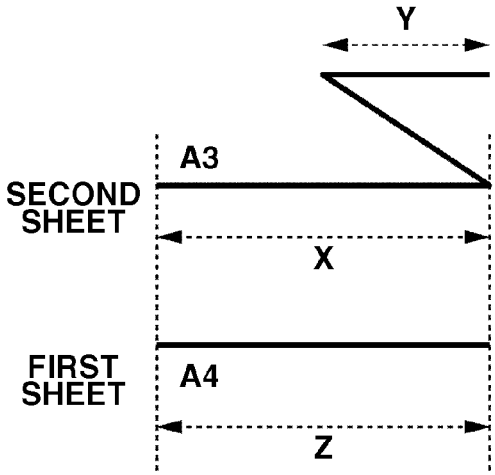
FIG. 12 illustrates an example of Z-folding processing in the image forming apparatus according to the present exemplary embodiment.
Figure 12B:
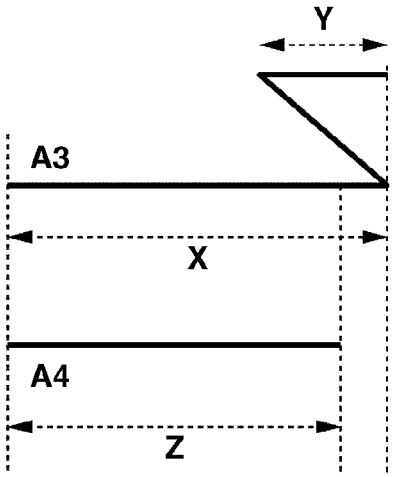

FIG. 12 is a diagram illustrating an example of Z-folding processing in the image forming apparatus 1 according to the present exemplary embodiment. This example describes both a case where a job is executed and a case where a job is not executed in Z-folding during mixed document size setting.

FIG. 12 (A) illustrates an example in which a folding width X is set to 210 mm in a job using an A4 sheet (first sheet) and an A3 sheet (second sheet). FIG. 12 (B) illustrates an example in which the folding width X is set to 230 mm in a job using an A4 sheet (first sheet) and an A3 sheet (second sheet).

In FIG. 12 (A), the width Z in the conveyance direction of the small sheet (A4 sheet) is 210 mm. Therefore, a relationship of Z=X holds in step S1105. In step S1107, the CPU 153 thus determines that the job is executed, so that a sheet bundle conforming to a form illustrated in FIG. 12 (A) is produced.

However, in FIG. 12 (B), the width Z in the conveyance direction of the small sheet (A4 sheet) is 210 mm. Therefore, a relationship of Z<X holds in step S1105. In step S1107, the CPU 153 thus determines that the job is stopped, so that a sheet bundle conforming to a form illustrated in FIG. 12 (B) is not produced.

According to the present exemplary embodiment, a sheet bundle including mixed sheets that differ in folding width and sheet size can be produced.

Furthermore, when the folding width X is greater than the width Z in the conveyance direction of the small sheet, the job is stopped, which can prevent production of a sheet bundle including sheets in which folding width X is above the width Z in the conveyance direction of the small sheet. The small size means the A4 size if the sizes of sheets on which a document is read from the document feeder 100 are the A4 size and the A3 size, for example. The CPU 153 acquires the small size before executing the job in a mixed document mode.

When the folding width X is smaller than the width Z in the conveyance direction of the small sheet, the job is not stopped. Accordingly, the present invention can be applied also to print on demand (POD) in which an excess portion is cut in post-processing.

In the above-mentioned exemplary embodiment, the CPU 153 determines whether folding processing can be performed in the mixed document size job based on the result of the determination by the CPU 153 whether Z<X in step S1105 after carrying out steps S1103 and S1104. However, sheet sizes used in a normal image forming apparatus often belong to A series, such as the A3 size and the A4 size, in many cases. Therefore, the CPU 153 may perform the determination in the Z-folding processing only when the user changes the folding width X. The exemplary embodiment will be described below.

Figure 13:
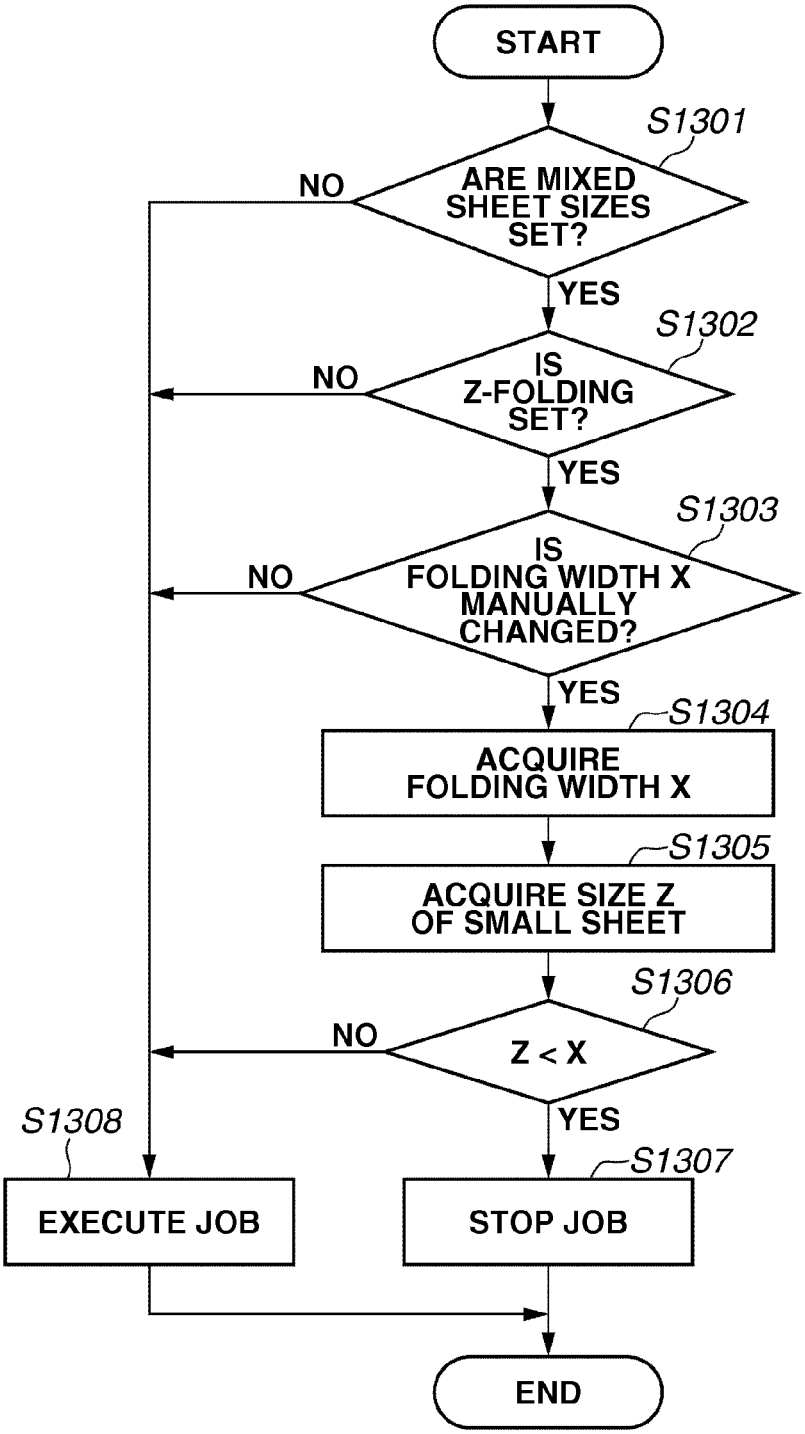
FIG. 13 is a flowchart illustrating an example of a sheet processing procedure in the image forming apparatus according to the present exemplary embodiment.

FIG. 13 is a flowchart illustrating an example of a sheet processing procedure in an image forming apparatus according to a second exemplary embodiment. This example describes job processing during folding mode setting.

A CPU 153 loads a control program stored in a ROM 151 into a RAM 152 and executes the control program, to realize each of steps S1301 to S1308. In this example, a period of time elapsed until a job is executed can be shortened by performing determination in step S1303 before step S1103 illustrated in FIG. 11.

In general, a value that can be customized for each user as represented by a folding width for Z-folding (FIG. 8), is previously stored in a nonvolatile memory in the image forming apparatus 1, for example, the ROM 151 as a general-purpose default value (i.e., as its initial value). Since sheets of sizes in A series such as the A3 size and the A4 size are used in many cases in Japan, for example, an A3 sheet may be matched to an A4 sheet in many cases in Z-folding processing. Therefore, 210 mm is registered as an initial value of the folding width X.

When an operation unit 801 accepts the pressing of a start key 809 from the user while a document to be printed is placed on a document feeder 100, the present processing is started.

In step S1301, the CPU 153 in the image forming apparatus 1 first determines whether mixed document sizes (FIG. 9) are set. If the CPU 153 determines that the mixed document (e.g., sheet) sizes are not set (NO in step S1301), then in step S1308, the CPU 153 executes a job, considering that the job is not a mixed document size job.

On the other hand, if the CPU 153 determines that the mixed document sizes are set (YES in step S1301), the processing proceeds to step S1302.

In step S1302, the CPU 153 in the image forming apparatus 1 determines whether Z-folding is set (FIG. 10). If the CPU 153 determines that Z-folding is not set (NO in step S1302), then in step S1308, the CPU 153 executes a job, considering that the job is a mixed document size job in which Z-folding is not performed.

On the other hand, if the CPU 153 determines that Z-folding is set (YES in step S1302), the processing proceeds to step S1303.

In step S1303 (i.e., is folding width X manually changed?), the CPU 153 in the image forming apparatus 1 checks whether the folding width X is changed from the initial value (=210 mm in this example) in width change determination processing. If the CPU 153 determines that the folding width X is not changed from the result of the width change determination processing (NO in step S1303), the processing proceeds to step S1308. In step S1308, the CPU 153 executes the job.

On the other hand, if the CPU 153 determines that the folding width X is changed (YES in step S1303), the processing proceeds to step S1304.

The processing in step S1304 and the subsequent steps are the same as those in steps S1103 to S1106 illustrated in the first exemplary embodiment and hence, the description thereof is not repeated.

According to the present exemplary embodiment, time and labor consumed to perform the processing in step S1304 and the subsequent steps can be saved by determining whether the user has manually changed the folding width X in step S1303 illustrated in FIG. 13. Therefore, the printing processing speed or the printing efficiency can be improved.

In the above-mentioned first exemplary embodiment, the job is stopped to terminate the processing when the CPU 153 determines that the width Z in the conveyance direction is less than the folding width X in step S1105. In this case, the input job is discarded. When folding setting is to be made again, therefore, job input processing must be similarly repeated. Therefore, the CPU 153 may adjust the folding width X when it is determined that the width Z in the conveyance direction is less than the folding width X in step S1105 so that the execution of the job is not stopped. The exemplary embodiment will be described below.

Figure 14:
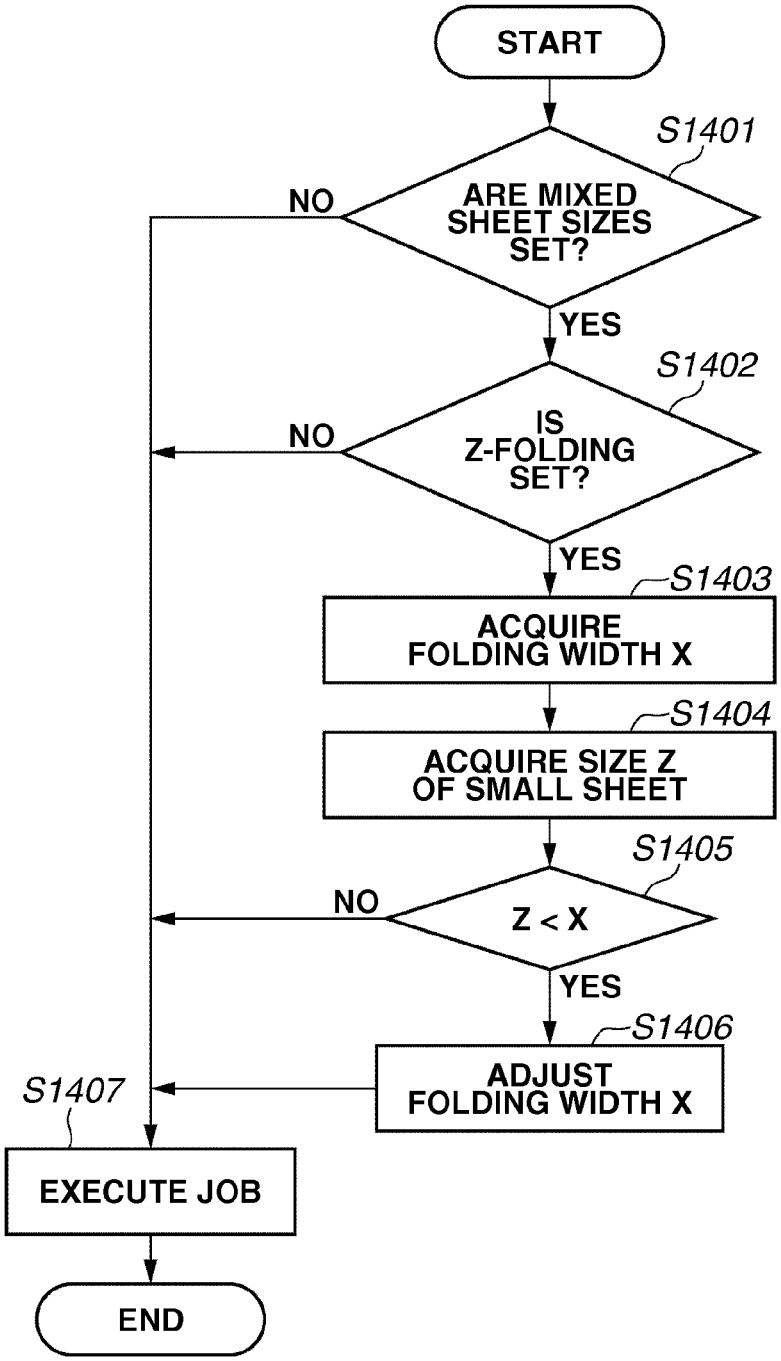
FIG. 14 is a flowchart illustrating an example of a sheet processing procedure in the image forming apparatus according to the present exemplary embodiment.

FIG. 14 is a flowchart illustrating an example of a sheet processing procedure in an image forming apparatus according to a third exemplary embodiment. This example describes job processing when folding mode setting is made.

A CPU 153 loads a control program stored in a ROM 151 into a RAM 152 and executes the control program, to realize each of steps S1401 to S1407. In this example, the job stop processing in step S1106 illustrated in FIG. 11 is changed to processing for adjusting a folding width X in step S1406.

Steps S1401 to S1405 are the same as those in steps S1101 to S1105 illustrated in FIG. 11 and hence, the description thereof is not repeated.

If the CPU 153 in the image forming apparatus 1 determines that the width Z in a conveyance direction is less than the folding width X (YES in step S1405), then in step S1406, the CPU 153 automatically adjusts the folding width X. More specifically, the CPU 153 substitutes the width Z in the conveyance direction into the folding width X. Then, the processing proceeds to step S1407. In step S1407, the CPU 153 in the image forming apparatus 1 executes a job.

At this time, the CPU 153 may also display a screen (not illustrated) for inputting the folding width X satisfying Z<X so that a user can set the folding width X again.

According to the third exemplary embodiment, the job can be continued without being interrupted, as in the first exemplary embodiment, by performing the processing in step S1406. Therefore, time and labor consumed for the user to input the job again can be saved.

In the above-mentioned third exemplary embodiment, the CPU 153 may also determine whether the folding width X has been manually changed when it is determined that Z-folding is set in step S1402, so that the processing in steps S1403 to S1406 is not performed. The exemplary embodiment will be described below.

Figure 15:
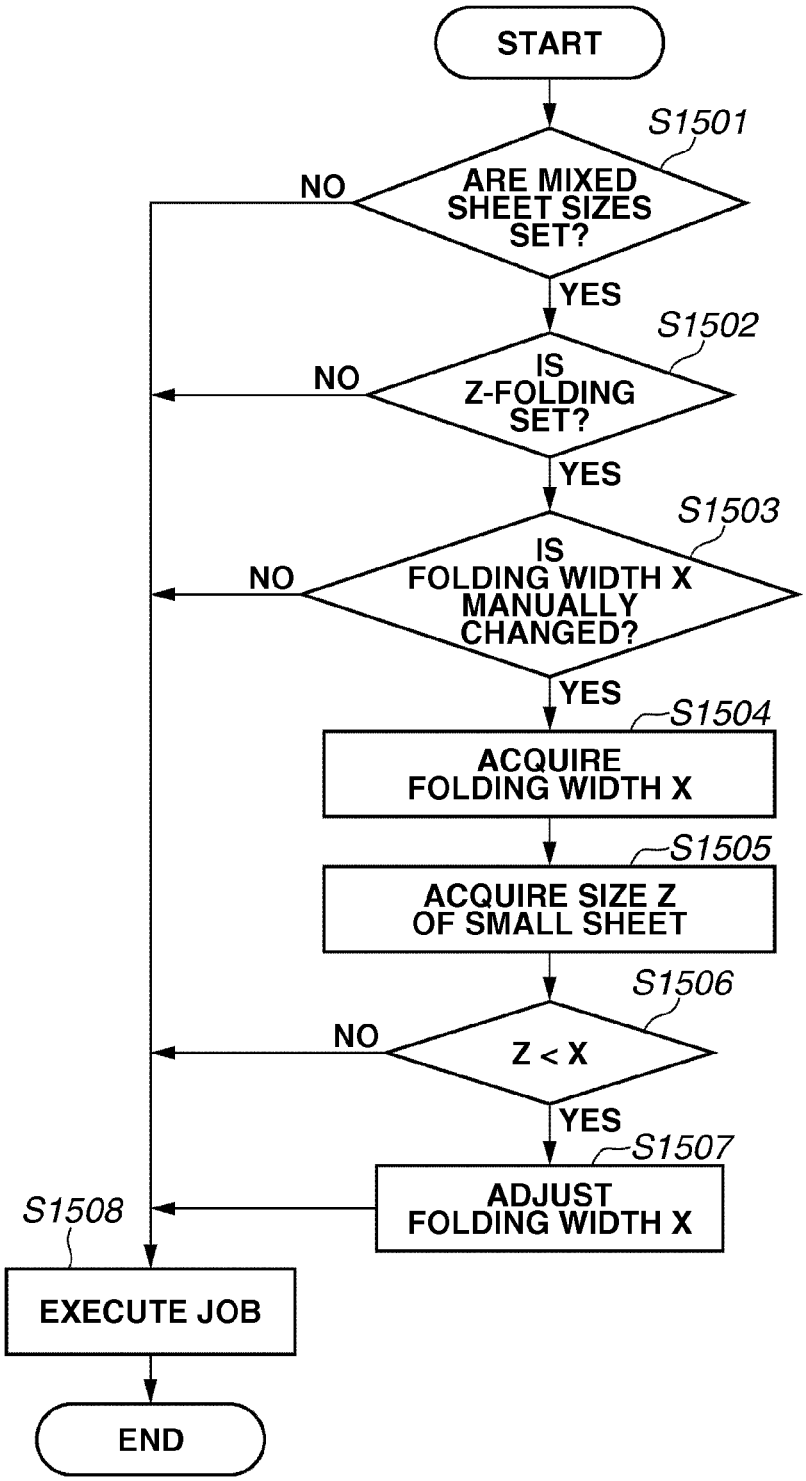
FIG. 15 is a flowchart illustrating an example of a sheet processing procedure in the image forming apparatus according to the present exemplary embodiment.

FIG. 15 is a flowchart illustrating an example of a sheet processing procedure in an image forming apparatus according to a fourth exemplary embodiment. This example describes job processing when folding mode setting is made.

A CPU 153 loads a control program stored in a ROM 151 into a RAM 152 and executes the control program, to realize each of steps S1501 to S1508. In this example, processing for determining whether a folding width X has been manually changed is added between steps S1402 and S1403 illustrated in FIG. 14. More specifically, in a flowchart illustrated in FIG. 15, step S1503 is added to the flowchart illustrated in FIG. 14. The content of the added step is similar to that in the second exemplary embodiment.

The processing in the fourth exemplary embodiment is the same as those described in the second and third exemplary embodiments and hence, the description thereof is not repeated.

According to the fourth exemplary embodiment, time and labor consumed to perform processing in step S1504 and the subsequent steps can be saved. Therefore, the printing processing speed or the printing efficiency can be improved.

In the third exemplary embodiment, the job is stopped when the CPU 153 determines that the width Z in the conveyance direction is less than the folding width X in step S1405. However, there is a case where a user desires to set a folding width X exceeding the width Z in a conveyance direction of sheets of a small size. Therefore, a screen may be displayed to cause the user to confirm that the folding width X exceeding the width Z in the conveyance direction has been set. Therefore, it is determined by an instruction from the user via the screen whether a job is executed or stopped. The exemplary embodiment will be described.

Figure 16:
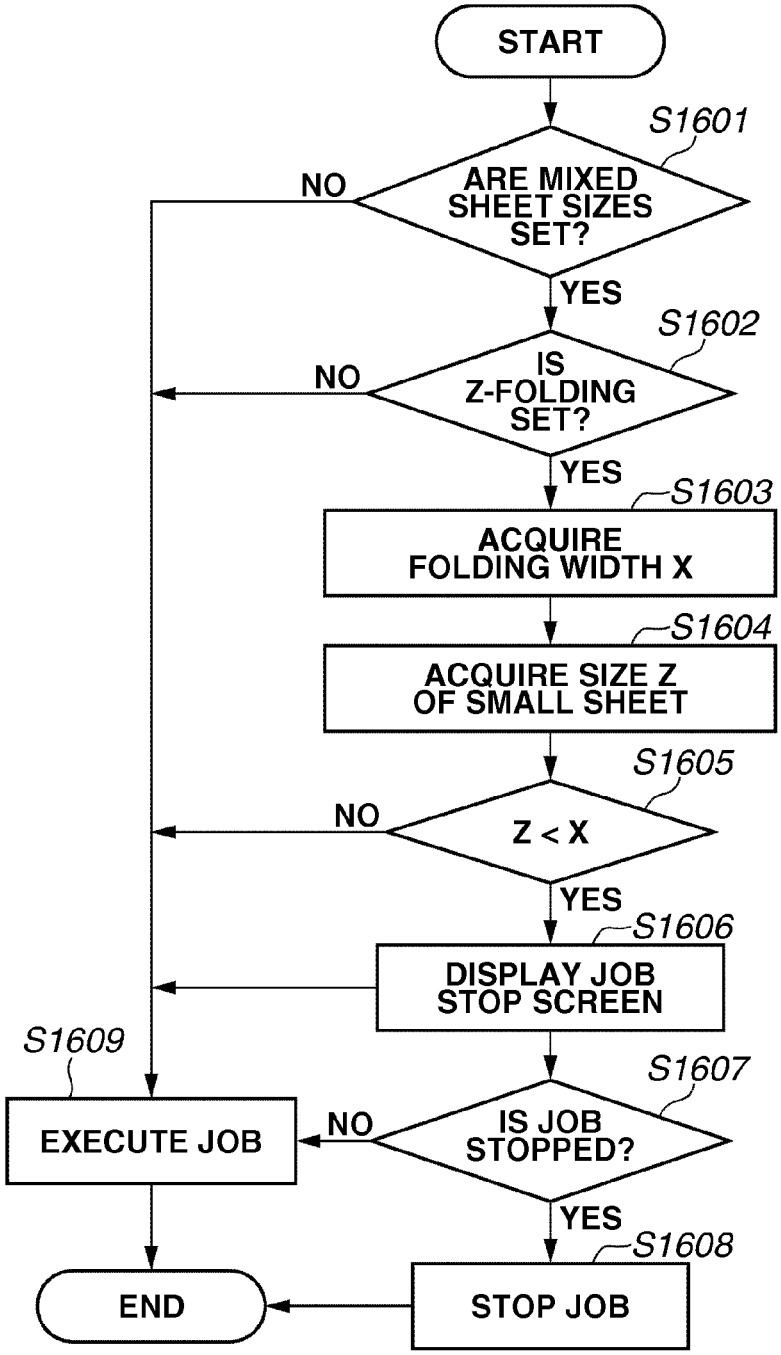
FIG. 16 is a flowchart illustrating an example of a sheet processing procedure in the image forming apparatus according to the present exemplary embodiment.

FIG. 16 is a flowchart illustrating an example of a sheet processing procedure in an image forming apparatus according to a fifth exemplary embodiment. This example describes job processing when folding mode setting is made.

A CPU 153 loads a control program stored in a ROM 151 into a RAM 152 and executes the control program, to realize each of steps S1601 to S1609. In this example, the processing in step S1406 and the subsequent processing illustrated in FIG. 14 are changed to processing in steps S1606, S1607, and S1608.

Steps S1601 to S1605 are the same as those in steps S1401 to S1405 illustrated in FIG. 14 and hence, the description thereof is not repeated.

Figure 17:
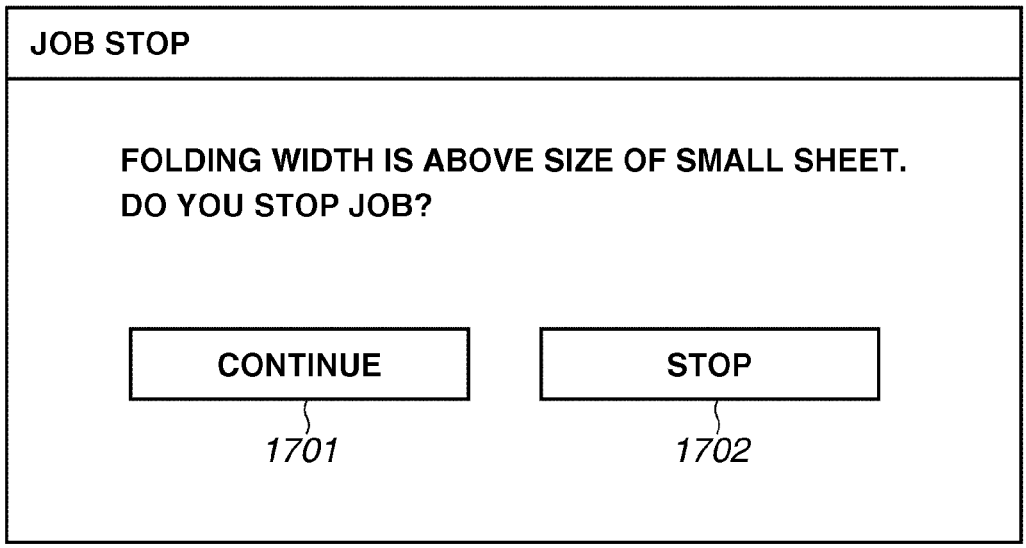
FIG. 17 illustrates an example of a job stop screen displayed on an operation unit illustrated in FIG. 2.

FIG. 17 illustrates an example of a job stop screen displayed on the operation unit 801 illustrated in FIG. 2.

This example screen includes a message for inquiring a user whether to stop the job, a CONTINUE key 1701 for giving an instruction to continue to execute the job, and a STOP key 1702 for stopping the execution of the job.

If the CPU 153 in the image forming apparatus 1 determines that the width Z in the conveyance direction is less than the folding width X (YES in step S1605), then in step S1606, the job stop screen illustrated in FIG. 17 is displayed on a liquid crystal panel 805 under the control of the CPU 153.

The user confirms the display of the job stop screen illustrated in FIG. 17, and presses the CONTINUE key 1701 when it desires to continue the job without changing the current folding width X. On the other hand, the user presses the STOP key 1702 when it desires to stop the job.

In step S1607, the CPU 153 determines whether the job is stopped. If the CPU 153 determines that the operation unit 801 accepts the pressing of the CONTINUE key 1701 (NO in step S1607), the processing proceeds to step S1609. In step S1609, the CPU 153 continues to execute the job.

On the other hand, if the CPU 153 determines that the operation unit 801 accepts the pressing of the STOP key 1702 (YES in step S1607), the processing proceeds to step S1608. In step S1608, the CPU 153 determines that the job is stopped and terminates the processing.

According to the fifth exemplary embodiment, even when the user desires to set the folding width X exceeding the width Z in the conveyance direction, the job can be continued.

Figure 18:
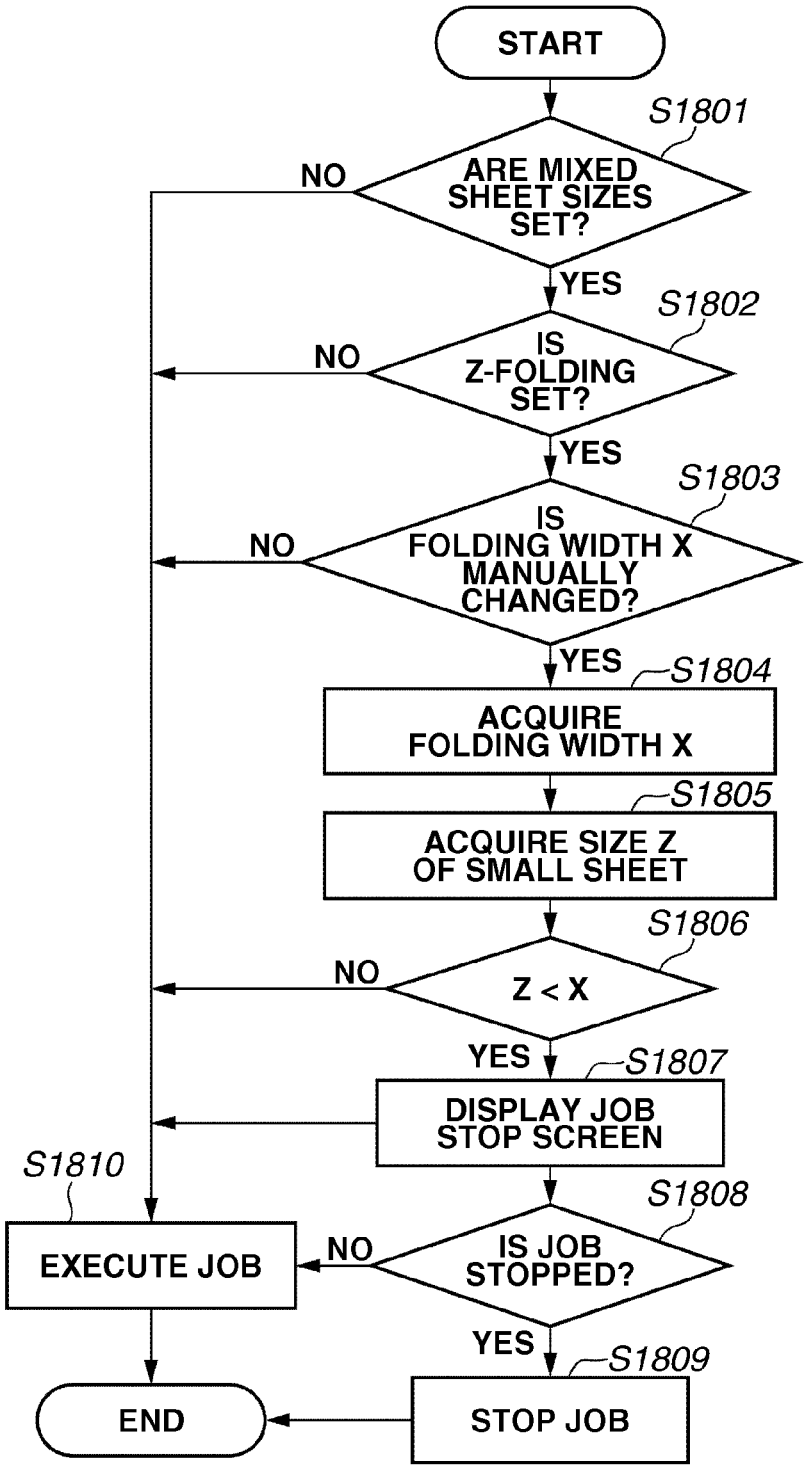
FIG. 18 is a flowchart illustrating an example of a sheet processing procedure in the image forming apparatus according to the present exemplary embodiment.

FIG. 18 is a flowchart illustrating an example of a sheet processing procedure in an image forming apparatus according to a sixth exemplary embodiment. This example describes job processing when folding mode setting is made.

A CPU 153 loads a control program stored in a ROM 151 into a RAM 152 and executes the control program, to realize each of steps S1801 to S1810. In this example, the processing for determining whether the folding width X has been manually changed, which is described in step S1303 illustrated in the second exemplary embodiment, is added between steps S1602 and S1603 illustrated in the fifth exemplary embodiment. More specifically, the flowchart illustrated in FIG. 18 is step S1803 added to the flowchart illustrated in FIG. 16. The content of the added step is similar to that in the second exemplary embodiment.

In the sixth exemplary embodiment, the contents of processing are the same as those in the second exemplary embodiment and the fifth exemplary embodiment and hence, the description thereof is not repeated.

According to the sixth exemplary embodiment, time and labor consumed to perform the processing in step S1804 and the subsequent steps can be saved. Therefore, the printing processing speed or the printing efficiency can be improved.

Aspects of the present invention can also be realized by a computer of a system or apparatus (or devices such as a CPU or MPU) that reads out and executes a program recorded on a memory device to perform the functions of the above-described embodiment (s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2008-332941 filed Dec. 26, 2008, which is hereby incorporated by reference herein in its entirety.

What is claimed is:

1. An apparatus comprising:

an execution unit configured to execute a job using both first sheets and second sheets, the second sheets having a larger size than the first sheets;

a setting unit configured to set a folding width for performing folding processing on the second sheets, based on a user's input;

a control unit configured to control the execution unit to execute the job, in a case where a size of the second sheets, which is to be obtained when the folding processing is performed based on the set folding width, is smaller than or equal to a size of the first sheets; and a displaying unit configured to display a screen for a user to instruct to continue execution of the job or to stop execution of the job, in a case where a size of the second sheet, which is to be obtained when the folding processing is performed based on the set folding width, is larger than a size of the first sheets, wherein the control unit determines whether to continue execution of the job or to stop execution of the job, based on the user's instruction input via the screen displayed by the displaying unit, in a case where a size of the second sheet, which is to be obtained when the folding processing is performed based on the set folding width, is larger than a size of the first sheets.

2. The apparatus according to claim 1, further comprising:

a determining unit configured to determine a default folding width for performing folding processing on the second sheets, based on a size of the first sheets and a size of the second sheets, wherein the setting unit changes the determined default folding width based on a user's input.

3. The apparatus according to claim 1, further comprising:

a folding unit configured to perform folding processing on a sheet.

4. A method comprising:

executing a job using both first sheets and second sheets, the second sheets having a larger size than the first sheets;

setting a folding width for performing folding processing on the second sheets, based on a user's input;

controlling the executing to execute the job, in a case where a size of the second sheets, which is to be obtained when the folding processing is performed based on the set folding width, is smaller than or equal to a size of the first sheets; and displaying a screen for a user to instruct to continue execution of the job or to stop execution of the job, in a case where a size of the second sheet, which is to be obtained when the folding processing is performed based on the set folding width, is larger than a size of the first sheets, wherein the controlling determines whether to continue execution of the job or to stop execution of the job, based on the user's instruction input via the screen displayed by the displaying, in a case where a size of the second sheet, which is to be obtained when the folding processing is performed based on the set folding width, is larger than a size of the first sheets.

5. The method according to claim 4, further comprising:

determining a default folding width for performing folding processing on the second sheets, based on a size of the first sheets and a size of the second sheets, wherein the setting changes the determined default folding width based on a user's input.

6. The method according to claim 4, further comprising performing folding processing on a sheet.

7. A non-transitory computer readable storage medium storing a computer-executable program of instructions that, when executed by a processor, cause the processor to perform operations comprising:

executing a job using both first sheets and second sheets, the second sheets having a larger size than the first sheets;

setting a folding width for performing folding processing on the second sheets, based on a user's input;

controlling the executing to execute the job, in a case where a size of the second sheets, which is to be obtained when the folding processing is performed based on the set folding width, is smaller than or equal to a size of the first sheets; and displaying a screen for a user to instruct to continue execution of the job or to stop execution of the job, in a case where a size of the second sheet, which is to be obtained when the folding processing is performed based on the set folding width, is larger than a size of the first sheets, wherein the controlling determines whether to continue execution of the job or to stop execution of the job, based on the user's instruction input via the screen displayed by the displaying, in a case where a size of the second sheet, which is to be obtained when the folding processing is performed based on the set folding width, is larger than a size of the first sheets.

8. The non-transitory computer readable storage medium according to claim 7, wherein the instructions further comprising instructions that, when executed by the processor, cause the processor to perform operations comprising:

determining a default folding width for performing folding processing on the second sheets, based on a size of the first sheets and a size of the second sheets, wherein the setting changes the determined default folding width based on a user's input.

9. The non-transitory computer readable storage medium according to claim 7, wherein the instructions further comprising instructions that, when executed by the processor, cause the processor to perform operations comprising performing folding processing on a sheet.

10. A system comprising:

an execution unit configured to execute a job using first sheets and second sheets, the second sheets having a larger size than the first sheets;

a folding unit configured to perform folding processing on a sheet;

a setting unit configured to set a folding width for performing the folding processing on the second sheets, based on a user's input;

a control unit configured to control the execution unit to execute the job, in a case where a size of the second sheets, which is to be obtained when the folding processing is performed based on the set folding width, is smaller than or equal to a size of the first sheets; and a displaying unit configured to display a screen for a user to instruct to continue execution of the job or to stop execution of the job, in a case where a size of the second sheet, which is to be obtained when the folding processing is performed based on the set folding width set by the setting unit, is larger than a size of the first sheets, wherein the control unit determines whether to continue execution of the job or to stop execution of the job, based on the user's instruction input via the screen displayed by the displaying unit, in a case where a size of the second sheet, which is to be obtained when the folding processing is performed based on the set folding width, is larger than a size of the first sheets.

* * * * *